US007559378B2

(12) United States Patent
Moeny

(10) Patent No.: US 7,559,378 B2
(45) Date of Patent: Jul. 14, 2009

(54) PORTABLE AND DIRECTIONAL ELECTROCRUSHING DRILL

(75) Inventor: William M. Moeny, Bernalillo, NM (US)

(73) Assignee: Tetra Corporation, Albuquerque, NM (US)

( * ) Notice: Subject to any disclaimer, the term of this patent is extended or adjusted under 35 U.S.C. 154(b) by 363 days.

(21) Appl. No.: 11/479,346

(22) Filed: Jun. 29, 2006

(65) Prior Publication Data

US 2006/0243486 A1 Nov. 2, 2006

Related U.S. Application Data

(63) Continuation-in-part of application No. 11/360,118, filed on Feb. 22, 2006, which is a continuation-in-part of application No. 11/208,671, filed on Aug. 19, 2005, now Pat. No. 7,416,032.

(60) Provisional application No. 60/603,509, filed on Aug. 20, 2004.

(51) Int. Cl.
*E21B 7/04* (2006.01)
*E21B 7/15* (2006.01)

(52) U.S. Cl. ..... 175/16; 175/73

(58) Field of Classification Search ..... 175/16; 299/14

See application file for complete search history.

(56) References Cited

U.S. PATENT DOCUMENTS

| | | | |
|---|---|---|---|
| 2,822,148 | A | 2/1958 | Murray |
| 3,076,513 | A | 2/1963 | Heaphy |
| 3,158,207 | A | 11/1964 | Rowley |
| 3,500,942 | A | 3/1970 | Smith |
| 3,539,406 | A | 11/1970 | Lissant |
| 3,679,007 | A | 7/1972 | O'Hare |
| 3,715,082 | A | 2/1973 | Carley-Macauly et al. |
| 3,840,078 | A | 10/1974 | Allgood et al. |
| 3,974,116 | A | 8/1976 | Lissant |
| 4,122,387 | A | 10/1978 | Ajam et al. |
| 4,540,127 | A | 9/1985 | Andres |
| 4,741,405 | A | 5/1988 | Moeny et al. |
| 5,019,119 | A | 5/1991 | Hare, Sr. |
| 5,386,877 | A | 2/1995 | Codina et al. |
| 5,425,570 | A | 6/1995 | Wilkinson |
| 5,573,307 | A | 11/1996 | Wilkinson et al. |
| 5,685,377 | A | 11/1997 | Arstein et al. |
| 5,864,064 | A | 1/1999 | Kano et al. |
| 5,896,938 | A | 4/1999 | Moeny et al. |
| 6,116,357 | A | 9/2000 | Wagoner et al. |

(Continued)

FOREIGN PATENT DOCUMENTS

| | | |
|---|---|---|
| WO | WO-03/069110 | 8/2003 |

OTHER PUBLICATIONS

Et al., "Plasma blasting in the Canadian Mining Industry", *Energy, Mines and Resources, Energy Diversification Research Laboratory, Cadet Newsletter* No. 4 Dec. 1990, 1-4.

(Continued)

*Primary Examiner*—Hoang Dang
(74) *Attorney, Agent, or Firm*—Deborah A. Peacock; Vidal A. Oaxaca; Peacock Myers, P.C.

(57) ABSTRACT

The present invention relates to a portable, directional electrocrushing drilling apparatus and method.

40 Claims, 11 Drawing Sheets

U.S. PATENT DOCUMENTS

| | | | | |
|---|---|---|---|---|
| 6,145,934 | A | 11/2000 | Arai et al. | |
| 6,164,388 | A | 12/2000 | Martunovich et al. | |
| 6,173,787 | B1 | 1/2001 | Wittrisch | |
| 6,215,734 | B1 | 4/2001 | Moeny et al. | |
| 6,280,519 | B1 | 8/2001 | Yezrielev et al. | |
| 6,761,416 | B2 | 7/2004 | Moeny et al. | |
| 7,270,195 | B2 * | 9/2007 | MacGregor et al. | 175/16 |
| 2002/0002933 | A1 | 1/2002 | Yezrielev et al. | |

OTHER PUBLICATIONS

"Plasma blasting in the Canadian Mining Industry", *Energy, Mines and Resources, Energy Diversification Research Laboratory, Cadet Newsletter* No. 4 Dec. 1990, 1-4.

Brady, M.E. et al., "Pulsed Plasma Thruster Ignitor Plug Ignition Characteristics", *Presented as a paper at the AIAA/ASME Third Joint Thermophysics Conference*, St. Louis, MO Jun. 1982.

Goldstein, S. et al., "Electric Cartridge Guns Using Fluids Heated by a Capillary Plasma Jet—An Extension of Classical Gun Technology to High Velocities", *Abstract—GT-Devices Inc.*, Alexandria, VA Sep. 1983.

Yan, K. et al., "A 10 kW high-voltage pulse generator for corona plasma generation", *Rev. Sci. Instrum*. 72, 2443 2001.

Zeimer, J.K. et al., "Performance Characterization of a High Efficiency Gas-Fed Pulsed Plasma Thruster", *33rd Joint Propulsion Conference*, Seattle, Washing Jul. 1997, 3-4.

Zeimer, J.K. et al., "Performance Scaling of Gas-Fed Pulsed Plasma Thrusters", *A Dissertation presented to the Faculty of Princeton University* Jun. 2001.

"Diekektrol-II Fluid", *GE Company Material Safety Data Sheet*, (Mar. 25, 1996).

"Dielectric Electrical Properties Polyglycols", ChemPoint.com.

"Dielektrol-I Fluid", *GE Company Material Safety Data Sheet*, (Mar. 25, 1996).

"Dielektrol-III Fluid", *GE Company Material Safety Data Sheet*, (Mar. 25, 1996).

"Dielektrol-IV Fluid", *GE Company Material Safety Data Sheet*, (May 23, 1996).

"Dielektrol-V Fluid", *GE Company Material Safety Data Sheet*, (Mar. 25, 1996).

"Dielektrol-VI Fluid", *GE Company Material Safety Data Sheet*, (Dec. 7, 1999).

"Dielektrol-VII Fluid", *GE Company Material Safety Data Sheet*, (Nov. 2, 1999).

"Geconol", *GE Company Material Safety Data Sheet*, (Mar. 25, 1996).

"ICOA Technical Bulletins", www.icoa.org.

"Polycin TC", *Caschem*.

"Spark Drills", *Advanced Drilling Techniques*, 508-540.

Akhmetov, I. G., et al., "The effect of a hydroelectric discharge on the capacitance and filtration properties of rocks", *Izv. Akad. Nauk Az. SSR, Ser. Nauk Zemie*, (1983),128-131.

Andres, U. , "Electrical Disintegration of Rock", *Mineral Processing and Extractive Metallurgy Review*, 1995, vol. 14, (1995),87-110.

Andres, U. , et al., "Liberation of Mineral Constituents by High-Voltage Pulses", *Powder Technology*, 48, (1986),269-277.

Andres, U. , et al., "Liberation of minerals by high-voltage electrical pulses", *Powder Technology 104*, (Dec. 29, 1998),37-49.

Andres, U. T., "Liberation Study of Apatite Nepheline Ore Comminuted by Penetrating Electrical Discharges", *International Journal of Mineral Processing*, 4, (1977),33-38.

Andres, U. , "Parameters of Disintegration of Rock by Electrical Pulses", *Powder Technology*, 58, (1989),265-269.

Andres, U. , "Parameters of disintegration of rock by electrical pulses", *Powder Technol* v. 58, n 4 Aug. 1989,265-269.

Aso, H. , et al., "Temporary Ventilation Shaft Structure of Abo Tunnel on Chubu Thruway, Ewquipment Taking into Consideration Cold District and Winter Storage", *Kensetsu No Kikaika*, No. 555, (May 25, 1996),32-38.

Bindeman, Ilya N., "Fragmentation phenomena in populations of magmatic crystals", *American Mineralogist*, vol. 90, (2005),1801-1815.

Bluhm, H. , et al., "Application of Pulsed HV Discharges to Material Fragmentation and Recycling", *IEEE Transactions on Dielectrics and Electrical Insulation*, vol. 7, No. 5, (Oct. 2000),625-636.

Broyer, P. , et al., "New discharge circuit using high voltage transmission line for efficient shock wave generation; application to lithotripsy", *IEEE Ultrasonics Symposium* v 3, (1994).

Chaturvedi, Shashank , et al., "Modeling of shock-wave generation in water by electrical discharges", *IEEE Trans Plasma Sci*, vol. 28, No. 5, (Oct. 2000),1552-1557.

Cook, N.G.W. , et al., "Rock Fragmentation by Mechanical, Chemical and Thermal Methods", *VI International Mining Congress*, (1970),1-5.

Dubovenko, K. V., et al., "Underwater electrical discharge characteristics at high values of initial pressure and temperature", *IEEE International Conference on Plasma Science 1998*, (1998).

Furujo, A. , "Current Trends of Plasma Cutting Technology", *Yosetsu Gakkai-Shi* (*Journal of the Japan Welding Society*), Vo. 66, No. 7, (Oct. 5, 1997),33-37.

Hamelin, M. , et al., "Hard Rock Fragmentation with Pulsed Power", *1993 Pulsed Power Conference*, (1993),11-14.

Hasebe, T. , et al., "Focusing of Shock Wave by Underwater Discharge, On Nonlinear Reflection and Focusing Effect", *Zairyo* (*Journal of the Society of Materials Science*, Japan), vol. 45., No. 10, (Oct. 15, 1996),1151-1156.

Hawrylewicz, B. M., et al., "Experiment with Electric Discharge in Rock Splitting", *Society of Mining Engineers of AIME conference*, (1986),429-435.

Hawrylewicz, B. M., et al., "Experiment with Electric Discharge in Rock Splitting", *Symposium on Rock Mechanics 27th. Publ by Soc of Mining Engineers of AIME*, (1986).

Hawrylewicz, B. M., et al., "Experiment with electric discharge in rock splitting", *Symposium on Rock Mechanics*, vol. 27, (Jun. 1986),429-435.

Hogeland, Steve R., et al., "Aluminum-Enhanced Underwter Electrical Discharges for Steam Explosion Triggering", *Sandia National Labs*.

Huang, W. , et al., "Separation and preconcentration combined with glow discharge atomic emission spectrometry for the determination of rate earth elements (a, Nd< Eu, Dy, Y) in geological samples", *Fresenius' Journal of Analytical Chemistry*, (2000).

Huismann, G. , et al., "Arc Voltage Measurements of the Hyperbaric MIG Process", *14, International Conference on Offshore Mechanics Arctic Engineering* (*OMAE*), (Jun. 1996).

Inoue, Hirotoshi , et al., "Drilling of Hard Rocks by Pulsed Power", *2000IEEE*, vol. 16, No. 3, (Jun. 2000),19-25.

Inoue, Hirotoshi , et al., "Pulsed Electric Breakdown and Destruction of Granite", *Jp. J. Appl. Phys*. vol. 38, (Nov. 1, 1999),6502-6505.

Ivanov, V. V., et al., "Discharge-pulse technology of development of sulphidic ores at the bottom of ocean. The Part II", *Elektronnaya Obrabotka Materialov*, No. 1, (2002),57-63.

Kalyatskij, I. I., et al., "Optimization of wear of electrode systems under rock crushing by discharge-producing electrical pulses", *Elektron Obr Mater* n 01 Jan.-Feb. 1991, 43-45.

Kil'Keyev, R. , et al., "Aspects of absorption of microwave energy by frozen rock", (May 1, 1981),20-21.

Komatsubara, A. , "Recent trend of new flue gas treating technology", *R and D News Kansai*, (1993),33-35.

Kudo, K. , et al., "Application of the Electric Discharge Logging System", *SEGJ Conference*, (Oct. 1997).

Kudo, K. , et al., "Features of the Electric Discharge Logging System", *SEGJ Conference*, (Oct. 1997).

Kumazaki, K. , et al., "Production of Artificial Fulgurite by Utilizing Rocket Triggered Lightning", *Denki Gakkai Ronbunshi, A* (*Transactions of the Institute of Electrical Engineers of Japan, Fundamentals and Materials*), vol. 117, No. 10, (Sep. 20, 1997).

Kurihara, C. , et al., "Inventigation of Phenomena of Sourthern Hyogo Earthquake, and Observation of Thunderbolts in Winter Using the Integrated Thunderbolt Observation System", *Denryoku Chuo Kenkyusho Kenkyu Nenpo*, (Aug. 1996),50-53.

Lisitsyn, I.V. , et al., "Breakdown and destruction of heterogeneous solid dielectrics by high voltage pulses", *1998 American Institute of Physics*, (Sep. 10, 1998),6262-6267.
Lisitsyn, I. V., et al., "Role of electron clusters-Ectons-in the breakdown of solid dielectrics", *Physics of Plasma*, vol. 5, No. 12, (Dec. 1998),4484-4487.
Listisyn, I.V. , et al., "Drilling and Demolition of Rocks by Pulsed Power", *IEEE*, (1999),169-172.
Malyushevskij, P. P., et al., "Discharge-pulse technology of ming of sulphide ores on the bottom of the Ocean", *Elektronnaya Obrabotka Meterialov*, No. 2, (2002),45-57.
Malyushevskij, P. P., et al., "Discharge-pulse technology of mining of sulfidic ores at the bottom of ocean. Part I.", *Elektronnaya Obrabotka Materialov*, (2001),41-49.
Matsumoto, Takaaki , "Acceleration methods of Itonic clusters", *Japan Synchrotron Radiation*, (Jul. 14, 2000).
Matsumoto, Takaaki , "Feasibility of X-ray Laser by Underwater Spark Discharges", *Japan Atomic Energy Research Inst.*, (Nov. 1999).
Maurer, William C., "Advanced Drilling Techniques", *Petroleum Publishing Co.*, 139-146.
McClung, J. G., "The feasibility of developing a borehole sparker for geothermal wells", *EG and G Energy Measurements, Inc.*, (1997).
Mozumi, H. , et al., "Tunnel blasting with non-electric detonators in the Kamioka mine", *Kogyo Kayaku* (Japan, vol. 54, No. 1, (Feb. 25, 1993),44-49.
No Author, "Proceedings of the 23rd International Conference of Safety in Mines Research Institutes; Abstracts", *International Conference of Safety in Mines Research Institutes*, (1989).
No Author, "Proceedings of the eighteenth annual conference on explosives and blasting technique", *International Society of Explosives Engineers*, (1992).
Ploeger, M. , et al., "Optimisation of the core shroud bypass flow in the nuclear power plant Unterweser, Part 2: Hardway Implementation", *9, International Conference on Nuclear Engineering*, Nice Acropolis (France), (Jul. 1, 2001).
Pronko, S. , et al., "Megajoule Pulsed Power Experiments for Plasma Blasting Mining Applications", *1993 Pulsed Power Conference*, (1993),15-18.
Puharic, M. , et al., "Overvoltage Analysis on Submarine Cables of Atmospheric Origins and Due to Switching Operations", *CIRED: 14, International Conference and Exhibition on Electricity Distribution: Distributing Power for the Millennium*, (Jun. 1997).
Res, J. , et al., "Disintegration of hard rocks by the electrohydrodynamic method", *Mining Engineer*, 44 Jan. 1987,44-47.
Saini-Eidukat, Bernhardt , et al., "Liberation of Fossils Using High Voltage Electric Pulses", *Curator*, vol. 39, (1996),139-144.
Saprykin, Yu , et al., "Deformation of a spherical shell under internal loading by a shock generated by an underwater electrical discharge", *Sov Appl Mech*, (Oct. 1988),392-396.
Timoshkin, I.V. , et al., "Plasma Channel Microhole Drilling Technology", *Applied Electrical Technologies Group, Institute for Energy and Environment Department of Electronic & Electrical Engineering*, University of Strathclyde, Abstract No. 10774.
Vovchenko, A. I., et al., "Underwater pulse discharge (UPD) and its technological applications", *Proc 3 Int Conf Prop Appl Dielectr Mater. Publ by IEEE*, (1991),1254-1257.
Ward, C. R., et al., "Identificatio nof frictional ignition potential for rocks in Australian coal mines", *Symposium on Safety in Mines: the Role of Geology*, (Nov. 1997).
Weise, TH.H.G.G. , et al., "Experimental investigations on rock fractioning by replacing explosives with electrically generated pressure pulses", *IEEE International Pulsed Power Conference—Digest of Technical papersv* 1 1993, (1993).
Yokawa, S. , et al., "Pulse energization system applied for fluidized bed combustors", *Sumitomo Jukikai Giho*, ( Apr. 20, 1993),85-89.

* cited by examiner

PORTABLE AND DIRECTIONAL ELECTROCRUSHING DRILL

CROSS-REFERENCES TO RELATED APPLICATIONS

This application is a continuation-in-part application of U.S. patent application Ser. No. 11/360,118 titled "Portable Electrocrushing Drill", filed Feb. 22, 2006, which is a continuation-in-part of U.S. patent application Ser. No. 11/208,671 titled "Pulsed Electric Rock Drilling Apparatus", filed Aug. 19, 2005, which claims the benefit of the filing of U.S. Provisional Patent Application Ser. No. 60/603,509, entitled "Electrocrushing FAST Drill and Technology, High Relative Permittivity Oil, High Efficiency Boulder Breaker, New Electrocrushing Process, and Electrocrushing Mining Machine", filed on Aug. 20, 2004, and the specification and claims of those applications are incorporated herein by reference.

BACKGROUND OF THE INVENTION

1. Field of the Invention (Technical Field)

The present invention relates to an electrocrushing drill, particularly a portable drill that utilizes an electric spark, or plasma, within a substrate to fracture the substrate.

2. Description of Related Art

Note that where the following discussion refers to a number of publications by author(s) and year of publication, because of recent publication dates certain publications are not to be considered as prior art vis-a-vis the present invention. Discussion of such publications herein is given for more complete background and is not to be construed as an admission that such publications are prior art for patentability determination purposes.

Processes using pulsed power technology are known in the art for breaking mineral lumps. Typically, an electrical potential is impressed across the electrodes which contact the rock from a high voltage electrode to a ground electrode. At sufficiently high electric field, an arc or plasma is formed inside the rock from the high voltage electrode to the low voltage or ground electrode. The expansion of the hot gases created by the arc fractures the rock. When this streamer connects one electrode to the next, the current flows through the conduction path, or arc, inside the rock. The high temperature of the arc vaporizes the rock and any water or other fluids that might be touching, or are near, the arc. This vaporization process creates high-pressure gas in the arc zone, which expands. This expansion pressure fails the rock in tension, thus creating rock fragments.

It is advantageous in such processes to use an insulating liquid that has a high relative permittivity (dielectric constant) to shift the electric fields in to the rock in the region of the electrodes. Water is often used as the fluid for mineral disintegration process. The drilling fluid taught in U.S. patent application Ser. No. 11/208,766 titled "High Permittivity Fluid" is also applicable to the mineral disintegration process.

Another technique for fracturing rock is the plasma-hydraulic (PH), or electrohydraulic (EH) techniques using pulsed power technology to create underwater plasma, which creates intense shock waves in water to crush rock and provide a drilling action. In practice, an electrical plasma is created in water by passing a pulse of electricity at high peak power through the water. The rapidly expanding plasma in the water creates a shock wave sufficiently powerful to crush the rock. In such a process, rock is fractured by repetitive application of the shock wave. U.S. Pat. No. 5,896,938, to the present inventor, discloses a portable electrohydraulic drill using the PH technique.

The rock fracturing efficiency of the electrocrushing process is much higher than either conventional mechanical drilling or electrohydraulic drilling. This is because both of those methods crush the rock in compression, where rock is the strongest, while the electrocrushing method fails the rock in tension, where it is relatively weak. There is thus a need for a portable drill bit utilizing the electrocrushing methods described herein to, for example, provide advantages in underground hard-rock mining, to provide the ability to quickly and easily produce holes in the ceiling of mines for the installation of roofbolts to inhibit fall of rock and thus protect the lives of miners, and to reduce cost for drilling blast holes.

BRIEF SUMMARY OF THE INVENTION

The present invention provides an electrocrushing system, particularly a portable drilling apparatus that utilizes an electrical spark, or plasma, inside rock or other hard substrate to fracture the rock or hard substrate. The system comprises a housing incorporating a set of electrodes. The electrical spark or plasma is created by switching a high voltage pulse across two electrodes immersed in drilling fluid that insulates the electrodes from each other to direct the arc inside the rock. Without being bound to theory, the current flowing through the conduction path rapidly heats the rock and vaporizes a small portion. The rapid formation of the vapor creates pressure that fractures the rock or hard substrate.

Thus, an embodiment of the present invention comprises a pulsed power apparatus for passing a pulsed electrical current through a substrate to crush, fracture, or drill the substrate, the apparatus comprising a drill comprising a drill tip, an electrode assembly comprising at least one set of at least two electrodes disposed on the drill tip defining therebetween at least one electrode gap, the electrodes of each said set of electrodes oriented substantially along a face of the drill tip to pass pulsed electrical current through the substrate, a cable connecting the electrode assembly to a pulse generator, fluid flow means providing flushing fluid to the drill tip, and a drill stem assembly enclosing and supporting the electrode assembly and directionally controlling the drill while drilling.

The cable preferably comprises an outer covering for advancing the drill into a hole when a drill hole depth exceeds that of the drill stem. The outer covering preferably comprises a corrugated outer covering.

The apparatus further preferably comprises an insulator for insulating power feed from the drill stem. Preferably, the drill stem assembly further comprises a switch alternately connecting the electrode sets to the pulse generator via the cable. The cable may comprise multiple conductors to connect each of a plurality of the electrode sets independently to the pulse generator. The pulse generator may comprise a switch alternately connecting the pulse generator to multiple conductors of the cable connecting each of a plurality of the electrode sets independently to the pulse generator. The drill may further comprise a plurality of capacitors located in the drill stem assembly providing part or all of the electrical current feed to the plasmas of each a plurality of the electrode sets. The drill may further comprise a circuit component such as, but not limited to, capacitors, switches, inductors, or a combination thereof located in the drill stem providing part or all of an electrical current feed to plasmas of each of a plurality of electrode sets. The pulse generator may further comprise a switch to alternately connect the pulse generator to multiple conductors of the cable connecting each of a plurality of the electrode sets independently to the pulse generator, each electrode set further comprising circuit components such as, but not limited to, capacitors, inductors, and other circuit components located in the drill stem assembly providing part of all of an electrical current feed to plasmas of each electrode set.

The drill stem preferably comprises jets disposed near the insulator to provide a swirling action across a surface of the insulator to sweep out material particles. The drill stem preferably incorporates a capacitor to provide part or all of the electrical current feed to the plasma to enhance the peak current delivered to the substrate.

The apparatus preferably comprises a pressure switch in the drill stem cable assembly to inhibit operation of the drill unless adequate fluid is flowing through the drill stem assembly to provide adequate pressure for operation.

The electrode assembly preferably comprises a shape selected from the group consisting of coaxial electrodes, circular shaped electrodes, convoluted shape electrodes, and a combination thereof. The electrode assembly preferably comprises a replaceable electrode to accommodate high electrode erosion rates.

Preferably, the drill further comprises a capacitor located in the drill stem to provide part or all of the electrical current feed to the plasma.

The apparatus preferably further comprises a fluid containment component. Preferably, the fluid containment component comprises a flexible boot at the drill tip to entrap the fluid and provide a medium for insulating the electrodes during start-up of a drill hole and during the drilling process. In one embodiment, the flexible boot is attached to a drill holder. Preferably, the flexible boot is disposed on an end of the drill holder so that the boot has an angled surface to enable the drill to penetrate into the material at an angle to the material. In another embodiment, the flexible boot is attached to the drill stem. Preferably, the boot comprises an angled surface to enable the drill to penetrate into the material at an angle to the material.

The apparatus preferably further comprises a roller or slide drive corresponding to the cable for providing thrust of the drill into the material.

The pulse generator preferably comprises a sealed pulse generator. The fluid flow is preferably disposed in the drill stem assembly.

The apparatus preferably further comprises a capacitor located in the drill stem to provide part or all of the electrical current feed to the plasma.

The apparatus preferably further comprises a plurality of drill stems operating off a single pulse generator, preferably operating simultaneously.

The fluid may comprise an electrical conductivity less than approximately $10^{-5}$ mho/cm and a dielectric constant greater than approximately 6. The fluid may comprise treated water and further comprise a conductivity less than approximately $10^{-4}$ mho/cm and a dielectric constant greater than approximately 40.

Another embodiment of the present invention provides a method for passing a pulsed electrical current through a substrate, said method comprising providing a drill comprising a drill tip, an electrode assembly, a cable connected to a pulse generator, and a drill stem assembly, providing fluid at the drill tip, disposing at least one set of at least two electrodes on the drill bit defining therebetween at least one electrode gap, orienting the electrodes of each set of electrodes substantially along a face of the drill tip passing current through the substrate, drilling the substrate with the drill, and directionally controlling of the drill while drilling via the drill stem assembly.

The method preferably further comprises insulating power feed from the drill stem via an insulator. The method can further comprise providing a swirling fluid flow action across a surface of the insulator to sweep out material particles. The method can further comprise inhibiting operation of the drill unless adequate fluid is flowing through the drill stem assembly to provide adequate pressure for operation.

In providing electrodes, the method preferably further comprises providing disposable and replaceable electrodes to accommodate high electrode erosion rates.

The method may comprise incorporating a switch in the drill stem alternately connecting the electrode sets to the pulse generator via the cable. The method may further comprise, by connecting each of the electrode sets independently to the pulse generator, incorporating multiple conductors to the cable. The method may further comprise a switch in the pulse generator alternately connecting the pulse generator to multiple conductors of the cable by connecting each of the electrode sets independently to the pulse generator. The method may further comprise incorporating a plurality of capacitors to the drill, locating the capacitors in the drill stem, and providing part or all of the electrical current feed via the capacitors to plasmas of each electrode set. The method may further comprise incorporating a circuit component selected from the group consisting of capacitors, switches, inductors, and a combination thereof to the drill, locating the circuit component in the drill stem, and providing part or all of the electrical current feed via the circuit components to plasmas of each electrode set.

Preferably, providing an electrode assembly comprises providing an electrode with a shape to control location of the current through the substrate. The method preferably further comprises entrapping the fluid at the drill tip during start-up of a drill hole and during the drilling process.

The method preferably further comprises the step of providing part or all of the electrical current feed to the plasma at low inductance by providing a capacitor located in the drill stem. The method preferably further comprises penetrating the drill into the material at an angle to the material.

The method preferably further comprises advancing the drill into a hole when a drill hole depth exceeds that of the drill stem by providing a cable advance mechanism to push the drill stem and cable into the hole.

The method preferably further comprises operating a plurality of drills off a single pulse generator, and preferably operating the drills simultaneously.

An advantage of the present invention is improved drilling speed.

Another advantage of the present invention is the substantial improvement on the production of holes in a mine.

Other objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims. As will be realized, the invention is capable of a number of different embodiments and its details are capable of modification in various obvious aspects, all without departing from the scope of the invention. Accordingly, the drawings and description will be regarded as illustrative in nature and not as restrictive.

BRIEF DESCRIPTION OF THE SEVERAL VIEWS OF THE DRAWINGS

The accompanying drawings, which are incorporated into, and form a part of, the specification, illustrate one or more embodiments of the present invention and, together with the description, serve to explain the principles of the invention. The drawings are only for the purpose of illustrating one or more preferred embodiments of the invention and are not to be construed as limiting the invention. In the drawings.

DETAILED DESCRIPTION OF THE INVENTION

Figure 1:
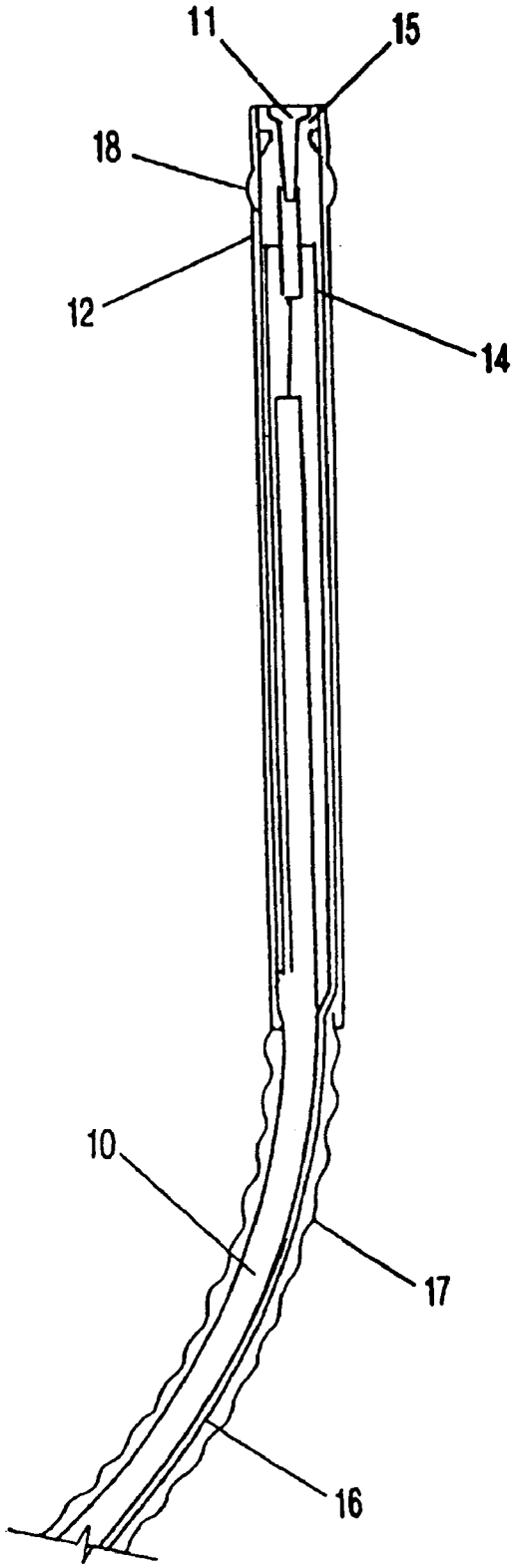
FIG. 1 is a close-up side cutaway view of an embodiment of the present invention showing a portable electrocrushing drill stem with a drill tip having replaceable electrodes.

The present invention provides an electrocrushing, portable drilling apparatus. As used herein, "drilling" is defined as excavating, boring into, making a hole in, or otherwise breaking and driving through a substrate. As used herein, "bit", "drill bit tip" and "drill tip" are defined as the working portion or end of a tool that performs a function such as, but not limited to, a cutting, drilling, boring, fracturing, or breaking action on a substrate (e.g., rock). As used herein, the term "pulsed power" is that which results when electrical energy is stored (e.g., in a capacitor or inductor) and then released into the load so that a pulse of current at high peak power is produced. "Electrocrushing" ("EC") is defined herein as the process of passing a pulsed electrical current through a mineral substrate so that the substrate is "crushed" or "broken". As used in the specification and claims herein, the terms "a", "an", and "the" mean one or more.

An embodiment of the present invention provides a drill bit on which is disposed one or more sets of electrodes. In this embodiment, the electrodes are disposed so that a gap is formed between them and are disposed on the drill bit so that they are oriented along a face of the drill bit. In other words, the electrodes between which an electrical current passes through a mineral substrate (e.g., rock) are not on opposite sides of the rock. Also, in this embodiment, it is not necessary that all electrodes touch the mineral substrate as the current is being applied. In accordance with this embodiment, at least one of the electrodes extending from the bit toward the substrate to be fractured and may be compressible (i.e., retractable) into the drill bit by any means known in the art such as, for example, via a spring-loaded mechanism.

The preferred embodiment of the present invention (see FIGS. 9-11) comprises a drill bit with multiple electrode sets arranged at the tip of the drill stem, each electrode set being independently supplied with electric current to pass through the substrate. By varying the repetition rate of the high voltage pulses, the drill changes direction towards those electrode sets having the higher repetition rate. Thus the multi-electrode set drill stem is steered through the rock by the control system, independently varying the pulse repetition rate to the electrode sets.

To accomplish the control of the electrode sets independently, a multi-conductor power cable is used with each electrode set connected, either separately or in groups, to individual conductors in the cable. A switch is used at the pulse generator to alternately feed the pulses to the conductors and hence to the individual electrode sets according to the requirements set by the control system. Alternatively, a switch is placed in the drill stem to distribute pulses sent over a single-conductor power cable to individual electrode sets. Because the role of each electrode set is to excavate a small amount of rock, it is not necessary for the electrode sets to operate simultaneously. A change in direction is achieved by changing the net amount of rock excavated on one side of the bit compared to the other side.

To further enhance the transmittal of power from the pulse generator to the rock, individual capacitors are located inside the drill stem, each connected, individually or in groups, to the individual electrode sets. This enhances the peak current flow to the rock, and improves the power efficiency of the drilling process. The combination of capacitors and switches, or other pulse forming circuitry and components such as inductors, are located in the drill stem to further enhance the power flow into the rock.

Accordingly, an embodiment of the present invention provides a drill bit on which is disposed one or more sets of electrodes. In this embodiment, the electrodes are disposed so that a gap is formed between them and are disposed on the drill bit so that they are oriented along a face of the drill bit. In other words, the electrodes between which an electrical current passes through a mineral substrate (e.g., rock) are not on opposite sides of the rock. Also, in this embodiment, it is not necessary that all electrodes touch the mineral substrate as the current is being applied. In accordance with this embodiment, at least one of the electrodes extending from the bit toward the substrate to be fractured and may be compressible (i.e., retractable) into the drill bit by any means known in the art such as, for example, via a spring-loaded mechanism.

Generally, but not necessarily, the electrodes are disposed on the bit such that at least one electrode contacts the mineral substrate to be fractured and another electrode that usually touches the mineral substrate but otherwise may be close to, but not necessarily touching, the mineral substrate so long as it is in sufficient proximity for current to pass through the mineral substrate. Typically, the electrode that need not touch the substrate is the central, not the surrounding, electrode.

Therefore, the electrodes are disposed on a bit and arranged such that electrocrushing arcs are created in the rock. High voltage pulses are applied repetitively to the bit to create repetitive electrocrushing excavation events. Electrocrushing drilling can be accomplished, for example, with a flat-end cylindrical bit with one or more electrode sets. These electrodes can be arranged in a coaxial configuration.

Generally, but not necessarily, the electrodes are disposed on the bit such that at least one electrode contacts the mineral substrate to be fractured and another electrode that usually touches the mineral substrate but otherwise may be close to, but not necessarily touching, the mineral substrate so long as it is in sufficient proximity for current to pass through the mineral substrate. Typically, the electrode that need not touch the substrate is the central, not the surrounding, electrode.

Therefore, the electrodes are disposed on a bit and arranged such that electrocrushing arcs are created in the rock. High voltage pulses are applied repetitively to the bit to create repetitive electrocrushing excavation events. Electrocrushing drilling can be accomplished, for example, with a flat-end cylindrical bit with one or more electrode sets. These electrodes can be arranged in a coaxial configuration.

An embodiment of the present invention incorporating a drill bit as described herein thus provides a portable electrocrushing drill that utilizes an electrical plasma inside the rock to crush and fracture the rock. A portable drill stem is preferably mounted on a cable (preferably flexible) that connects to, or is integral with, a pulse generator which then connects to a power supply module. A separate drill holder and advance mechanism is preferably utilized to keep the drill pressed up against the rock to facilitate the drilling process. The stem itself is a hollow tube preferably incorporating the insulator, drilling fluid flush, and electrodes. Preferably, the drill stem is a hard tubular structure of metal or similar hard material that contains the actual plasma generation. apparatus and provides current return for the electrical pulse. The stem comprises a set of electrodes at the operating end. Preferably, the drill stem includes a capacitor to enhance the current flow through the rock. These electrodes are typically circular in shape but may have a convoluted shape for preferential arc management. The center electrode is preferably compressible to maintain connection to the rock. The drill tip preferably incorporates replaceable electrodes, which are field replaceable units that can be, for example, unscrewed and replaced in the mine. Alternatively, the pulse generator and power supply module can be integrated into one unit. The electrical pulse is created in the pulse generator and then transmitted along the cable to the drill stem and preferably to the drill stem capacitor. The pulse creates an arc or plasma in the rock at the electrodes. Drilling fluid flow from inside the drill stem sweeps out the crushed material from the hole. The system is preferably sufficiently compact so that it can be manhandled inside underground mine tunnels.

When the drill is first starting into the rock, it is highly preferable to seal the surface of the rock in the vicinity of the starting point when drilling vertically. To accomplish this, a fluid containment or entrapment component provided to contain the drilling fluid around the head of the drill to insulate the electrodes. One illustrative embodiment of such a fluid containment component of the present invention comprises a boot made of a flexible material such as plastic or rubber. The drilling fluid flow coming up through the insulator and out the tip of the drill then fills the boot and provides the seal until the drill has progressed far enough into the rock to provide its own seal. The boot may either be attached to the tip of the drill with a sliding means so that the boot will slide down over the stem of the drill as the drill progresses into the rock or the boot may be attached to the guide tube of the drill holder so that the drill can progress into the rock and the boot remains attached to the launch tube.

The fluid used to insulate the electrodes preferably comprises a fluid that provides high dielectric strength to provide high electric fields at the electrodes, low conductivity to provide low leakage current during the delay time from application of the voltage until the arc ignites in the rock, and high relative permittivity to shift a higher proportion of the electric field into the rock near the electrodes. More preferably, the fluid comprises a high dielectric constant, low conductivity, and high dielectric strength. Still more preferably, the fluid comprises having an electrical conductivity less than $10^{-5}$ mho/cm and a dielectric constant greater than 6. The drilling fluid further comprises having a conductivity less than approximately $10^{-4}$ mho/cm and a dielectric constant greater than approximately 40 and including treated water.

The distance from the tip to the pulse generator represents inductance to the power flow, which impeded the rate of rise of the current is flowing from the pulse generator to the drill. To minimize the effects of this inductance, a capacitor is installed in the drill stem, to provide high current flow in to the rock plasma, to increase drilling efficiency.

The cable that carries drilling fluid and electrical power from the pulse generator to the drill stem is fragile. If a rock should fall on it or it should be run over by a piece of equipment, it would damage the electrical integrity, mash the drilling fluid line, and impair the performance of the drill. Therefore, this cable is preferably armored, but in a way that permits flexibility. Thus, for example, one embodiment comprises a flexible armored cable having a corrugated shape that is utilized as a means for advancing the drill into the hole when the drill hole depth exceeds that of the stem.

Preferably, a pulse power system that powers the bit provides repetitive high voltage pulses, usually over 30 kV. The pulsed power system can include, but is not limited to:

(1) a solid state switch controlled or gas-switch controlled pulse generating system with a pulse transformer that pulse charges the primary output capacitor;

(2) an array of solid-state switch or gas-switch controlled circuits that are charged in parallel and in series pulse-charge the output capacitor;

(3) a voltage vector inversion circuit that produces a pulse at about twice, or a multiple of, the charge voltage;

(4) An inductive store system that stores current in an inductor, then switches it to the electrodes via an opening or transfer switch; or (5) any other pulse generation circuit that provides repetitive high voltage, high current pulses to the drill bit.

The present invention substantially improves the production of holes in a mine. In an embodiment, the production drill could incorporate two drills operating out of one pulse generator box with a switch that connects either drill to the pulse generator. In such a scenario, one operator can operate two drills. The operator can be setting up one drill and positioning it while the other drill is in operation. At a drilling rate of 0.5 meter per minute, one operator can drill a one meter deep hole approximately every four minutes with such a set up. Because there is no requirement for two operators, this dramatically improves productivity and substantially reduces labor cost.

Turning now to the figures, which describe non-limiting embodiments of the present invention that are illustrative of the various embodiments within the scope of the present invention, FIG. 1 shows the basic concept of the drilling stem of a portable electrocrushing mining drill for drilling in hard rock, concrete or other materials. Pulse cable 10 brings an electrical pulse produced by a pulse modulator (not shown in FIG. 1) to drill tip 11 which is enclosed in drill stem 12. The electrical current creates an electrical arc or plasma inside the rock between drill tip 11 and drill stem 12. Drill tip 11 is preferably compressible to maintain contact with the rock to facilitate creating the arc inside the rock. A drilling fluid delivery component such as, but not limited to, fluid delivery passage 14 in stem 12 feeds drilling fluid through electrode gap 15 to flush debris out of gap 15. Drilling fluid passages 14 or other fluid in stem 12 are fed by a drilling fluid line 16 embedded with pulse cable 10 inside armored jacket 17. Boot holder 18 is disposed on the end of drill stem 12 to hold the boot (shown in FIG. 3) during the starting of the drilling process. Boot 23 is used to capture drilling fluid flow coming through gap 15 and supplied by drilling fluid delivery passage 14 during the starting process. As the drill progresses into the rock or other material, boot 23 slides down stem 12 and down armored jacket 17.

Figure 2:
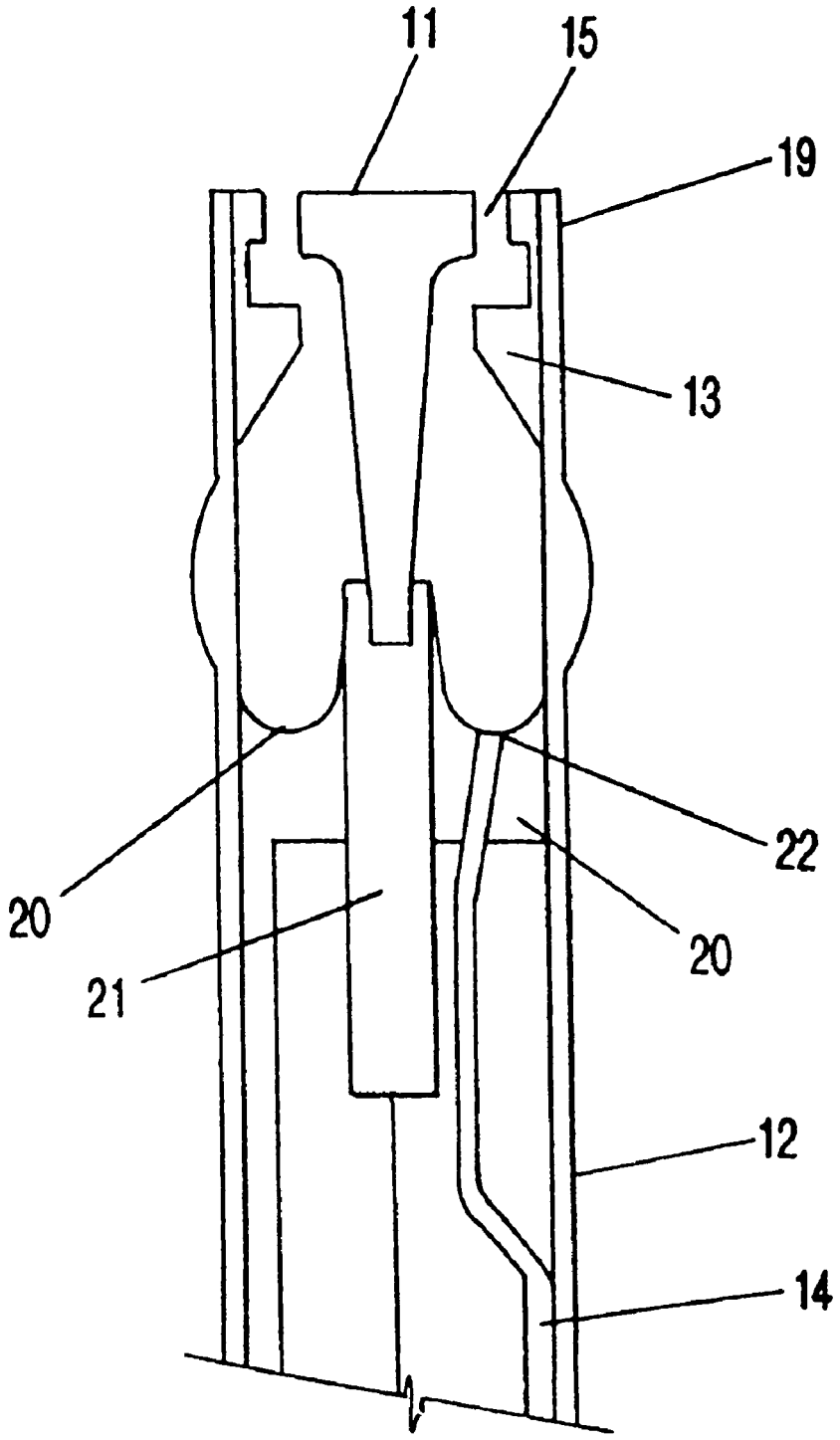
FIG. 2 is a close-up side cutaway view of the drill stem of FIG. 1 incorporating the insulator, drilling fluid flush, and electrodes.

FIG. 2 is a close-up view of tip 11 of portable electrocrushing drill stem 12, showing drill tip 11, discharge gap 15, and replaceable outer electrode 19. The electrical pulse is delivered to tip 11. The plasma then forms inside the rock between tip 11 and replaceable outer electrode 19. Insulator 20 has drilling fluid passages 22 built into insulator 20 to flush rock dust out of the base of insulator 20 and through gap 15. The drilling fluid is provided into insulator 20 section through drilling fluid delivery line 14.

Figure 3:
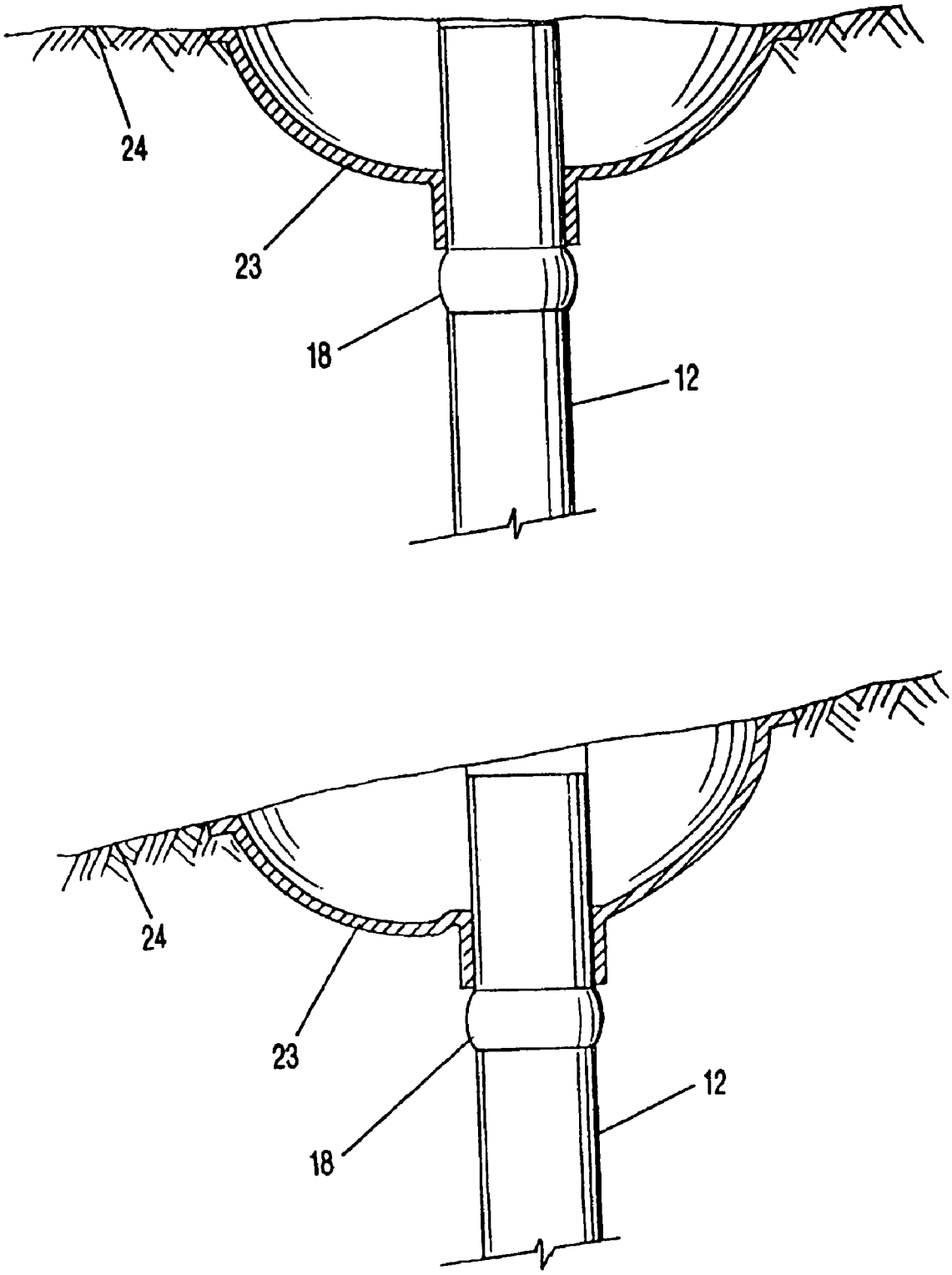
FIG. 3 is a side cutaway view of the preferred boot embodiment of the electrocrushing drill of the present invention.

FIG. 3 shows drill stem 12 starting to drill into rock 24. Boot 23 is fitted around drill stem 12, held in place by boot holder 18. Boot 23 provides means of containing the drilling fluid near rock surface 24, even when drill stem 12 is not perpendicular to rock surface 24 or when rock surface 24 is rough and uneven. As drill stem 12 penetrates into rock 24, boot 23 slides down over boot holder 18.

Figure 4:
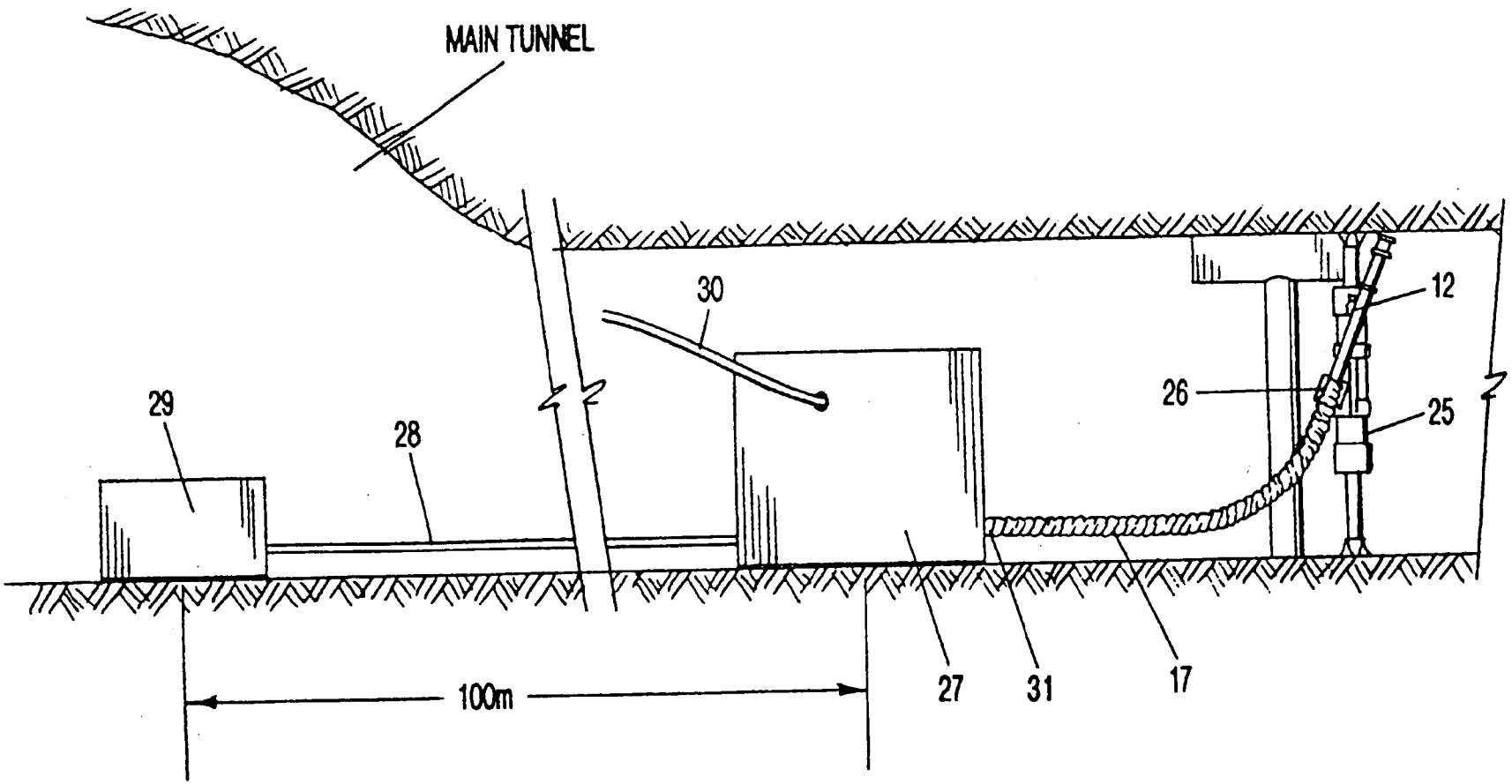
FIG. 4 is a side view of an alternative electrocrushing mining drill system of the present invention showing a version of the portable electrocrushing drill in a mine in use to drill holes in the roof for roofbolts.

FIG. 4 shows an embodiment of the portable electrocrushing mining drill utilizing drill stem 12 described in FIGS. 1-3. Drill stem 12 is shown mounted on jackleg support 25, that supports drill stem 12 and advance mechanism 26. Armored cable 17 connects drill stem 12 to pulse generator 27. Pulse generator 27 is then connected in turn by power cable 28 to power supply 29. Armored cable 17 is typically a few meters long and connects drill stem 12 to pulse generator 27. Armored cable 17 provides adequate flexibility to enable drill stem 12 to be used in areas of low roof height. Power supply 29 can be placed some long distance from pulse generator 27. Drilling fluid inlet line 30 feeds drilling fluid to drilling fluid line 16 (not shown) contained inside armored cable 17. A pressure switch (not shown) may be installed in drilling fluid line 16 to ensure that the drill does not operate without drilling fluid flow.

Figure 5:
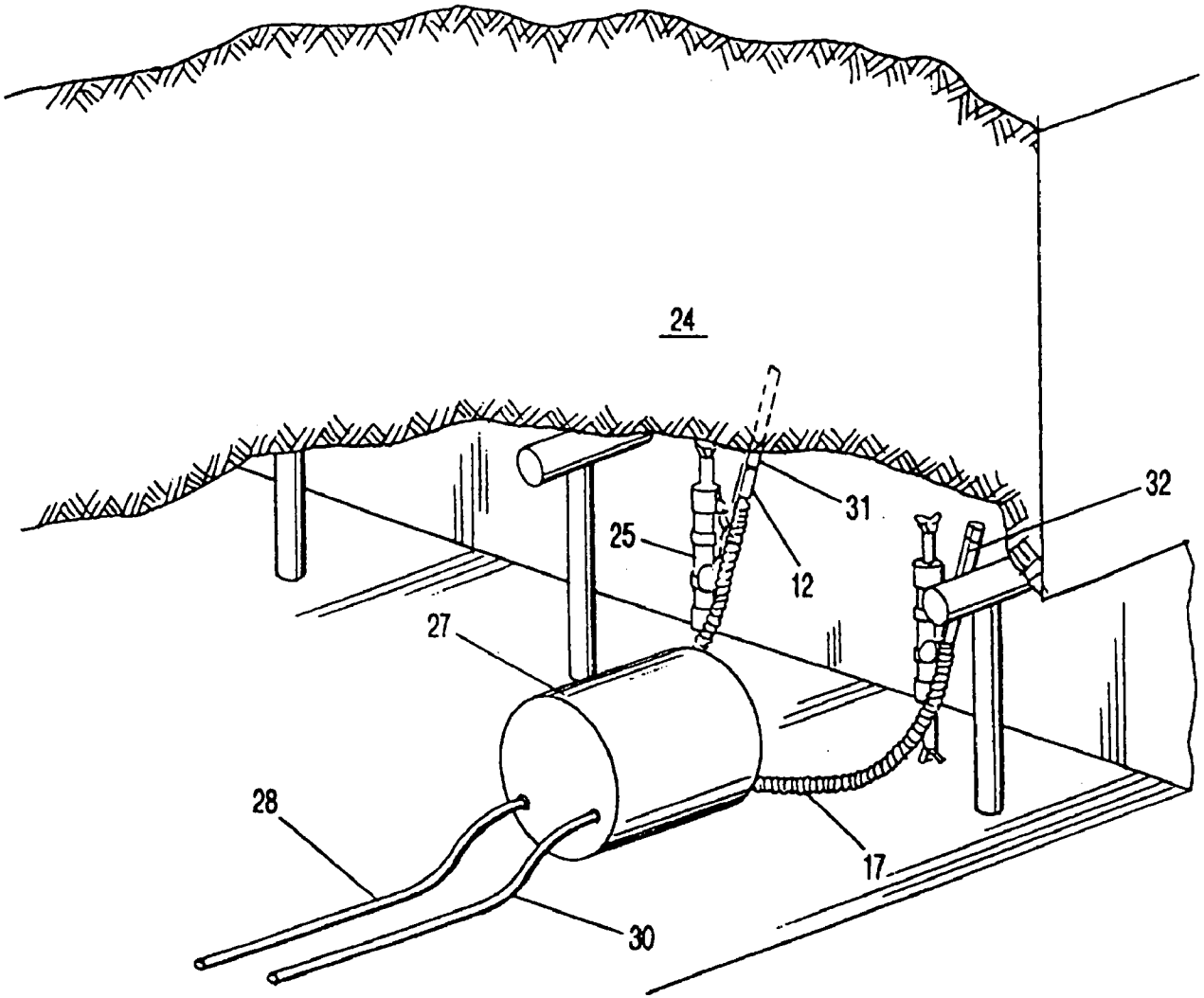
FIG. 5 is a side view of an alternative electrocrushing mining drill system of the present invention showing a version of the portable electrocrushing drill to drill holes in the roof for roofbolts and comprising two drills capable of non-simultaneous or simultaneous operation from a single pulse generator box.

FIG. 5 shows an embodiment of the subject invention with two drills being operated off single pulse generator 27. This figure shows drill stem 12 of operating drill 31 having progressed some distance into rock 24. Jack leg support 25 provides support for drill stem 12 and provides guidance for drill stem 12 to propagate into rock 24. Pulse generator 27 is shown connected to both drill stems 12. Drill 32 being set up is shown in position, ready to start drilling with its jack leg 25 in place against the roof. Power cable 28, from power supply 29 (not shown in FIG. 5) brings power to pulse generator 27. Drilling fluid feed line 30 is shown bringing drilling fluid into pulse generator 27 where it then connects with drilling fluid line 16 contained in armored cable 17. In this embodiment, while one drill is drilling a hole and being powered by the pulse generator, the second drill is being set up. Thus one man can accomplish the work of two men with this invention.

Figure 6:
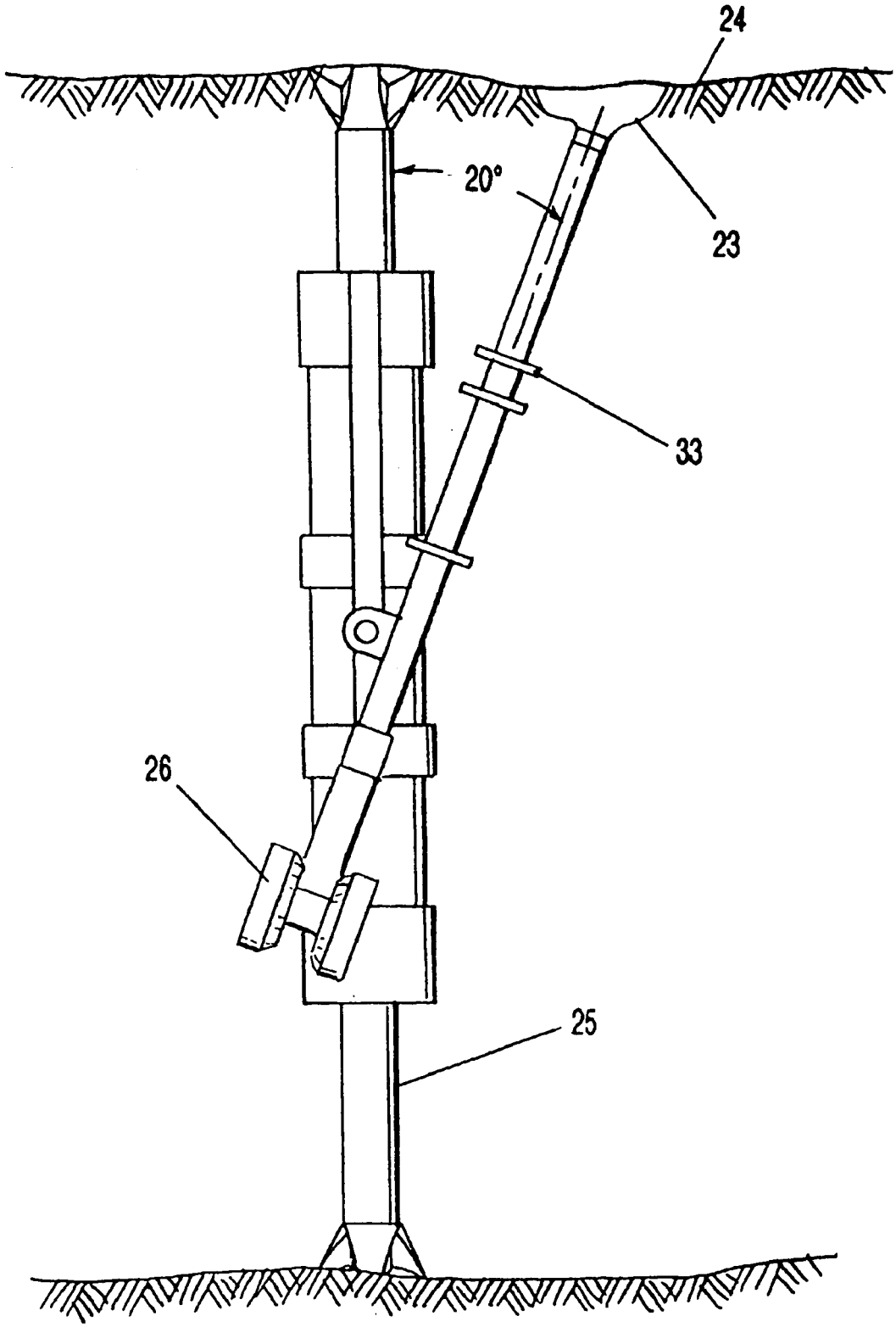
FIG. 6 is a view of the embodiment of FIG. 1 showing the portable electrocrushing drill support and advance mechanism.

FIG. 6 shows jack leg support 25 supporting guide structure 33 which guides drill 12 into rock 24. Cradle or tube guide structure 33 holds drill stem 12 and guides it into the drill hole. Guide structure 33 can be tilted at the appropriate angle to provide for the correct angle of the hole in rock 24. Fixed boot 23 can be attached to the end of guide tube 33 as shown in FIG. 6. Advance mechanism 26 grips the serrations on armored cable 17 to provide thrust to maintain drill tip 11 in contact with rock 24. Note that advance mechanism 26 does not do the drilling. It is the plasma inside the rock that actually does the drilling. Rather, advance mechanisms 26 keeps drill tip 15 and outer electrode 19 in close proximity to rock 24 for efficient drilling. In this embodiment, boot 23 is attached to the uppermost guide loop rather than to drill 12. In this embodiment, drill 12 does not utilize boot holder 18, but rather progresses smoothly through boot 23 into rock 24 guided by the guide loops that direct drill 12.

Figure 7:
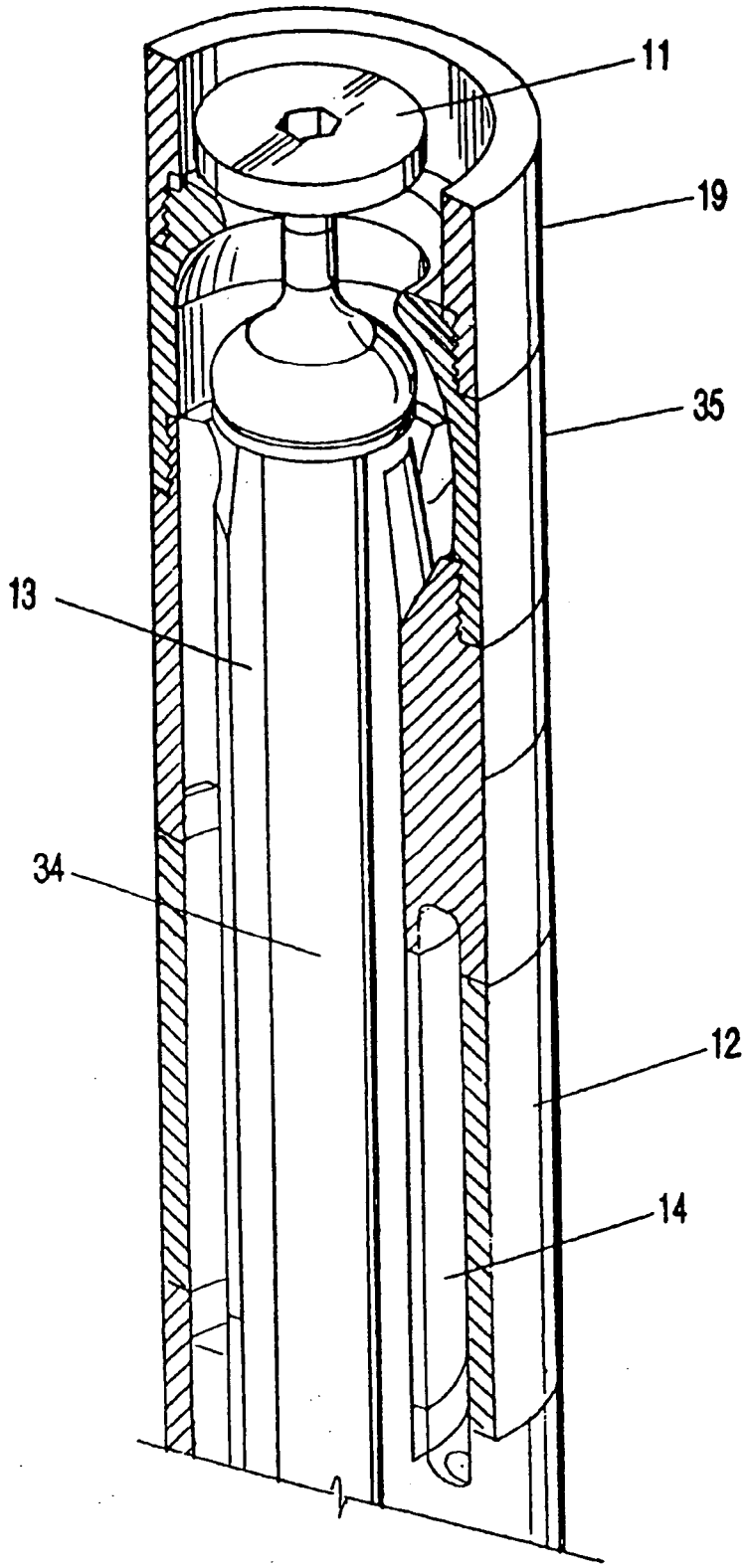
FIG. 7 is a close-up side cut-way view of an alternate embodiment of the drill stem.

FIG. 7 shows a further embodiment wherein the drilling fluid line is built into drill stem 12. Energy is stored in capacitor 13, which is delivered to tip 11 by conductor 34 when the electric field inside the rock breaks down the rock, creating a path for current conduction inside the rock. The low inductance created by the location of the capacitor in the stem dramatically increases the efficiency of transfer of energy into the rock. The capacitor is pulse charged by the pulse generator 27. Center conductor 34 is surrounded by capacitor 13, which then is nested inside drill stem 12 which incorporates drilling fluid passage 14 inside the stem wall. In this embodiment, drill tip 11 is easily replaceable and outer conductor 19 is easily replaceable. An alternative approach is to use slip-in electrodes 19 that are pinned in place. This is a very important feature of the subject invention because it enables the drill to be operated extensively in the mine environment with the high electrode erosion that is typical of high energy, high power operation.

Figure 8A:
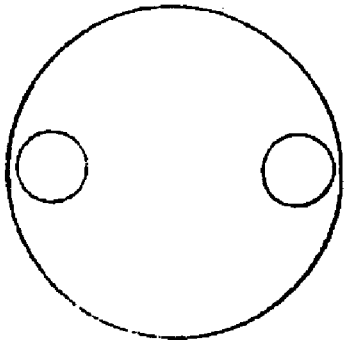
FIG. 8*a* shows an electrode configuration with circular shaped electrodes.
Figure 8B:
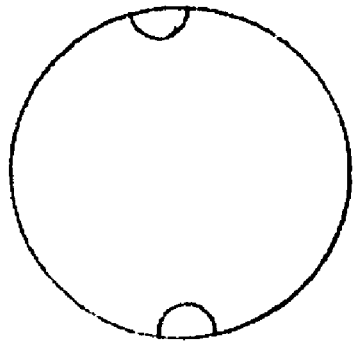
FIG. 8*b* shows another electrode configuration with circular shaped electrodes.
Figure 8C:
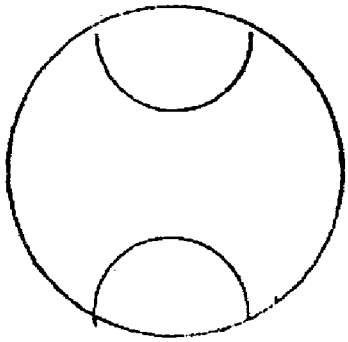
FIG. 8*c* shows another electrode configuration with circular shaped electrodes.
Figure 8D:
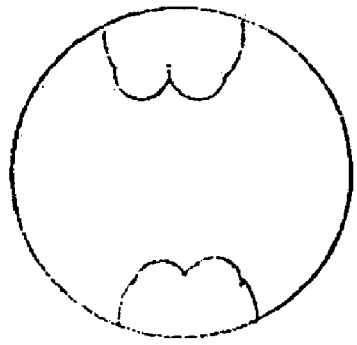
FIG. 8*d* shows a combination of circular and convoluted electrodes.
Figure 8E:
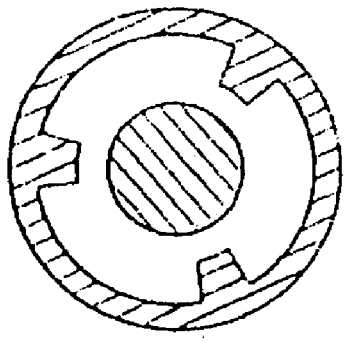
FIG. 8*e* shows convoluted shaped electrodes.

FIGS. 8*a*-8*d* show different, though not limiting, embodiments of the electrode configurations useable in the present invention. FIGS. 8*a*, 8*b*, and 8*c* show circular electrodes, FIG. 8*e* shows convoluted shape electrodes (the outer electrodes are convoluted), and FIG. 8*d* shows a combination thereof. FIG. 7 shows a coaxial electrode configuration. For longer holes or for holes with a curved trajectory, the multi-electrode set drill tip is used.

Figure 9:
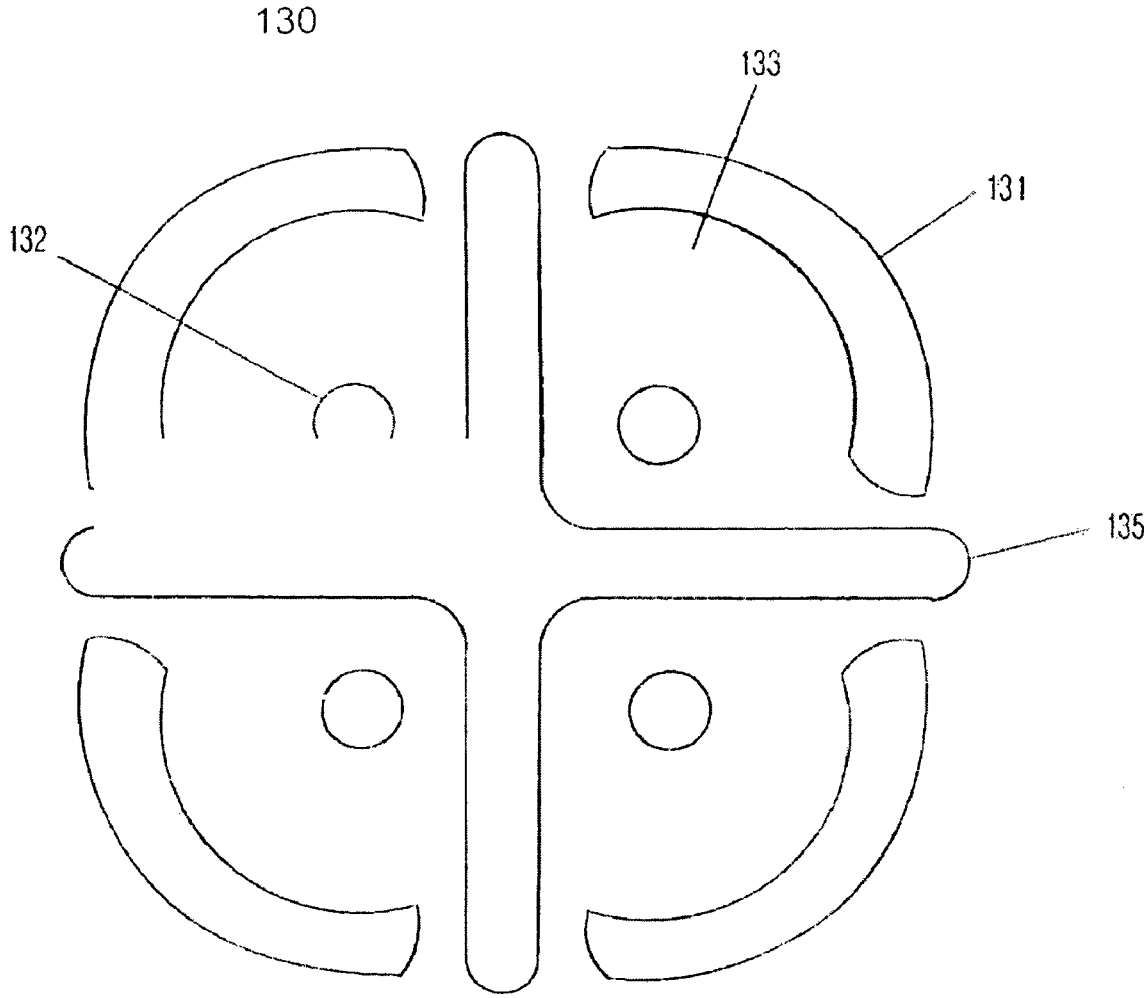
FIG. 9 shows a multi-electrode set drill tip for directional drilling.
Figure 10:
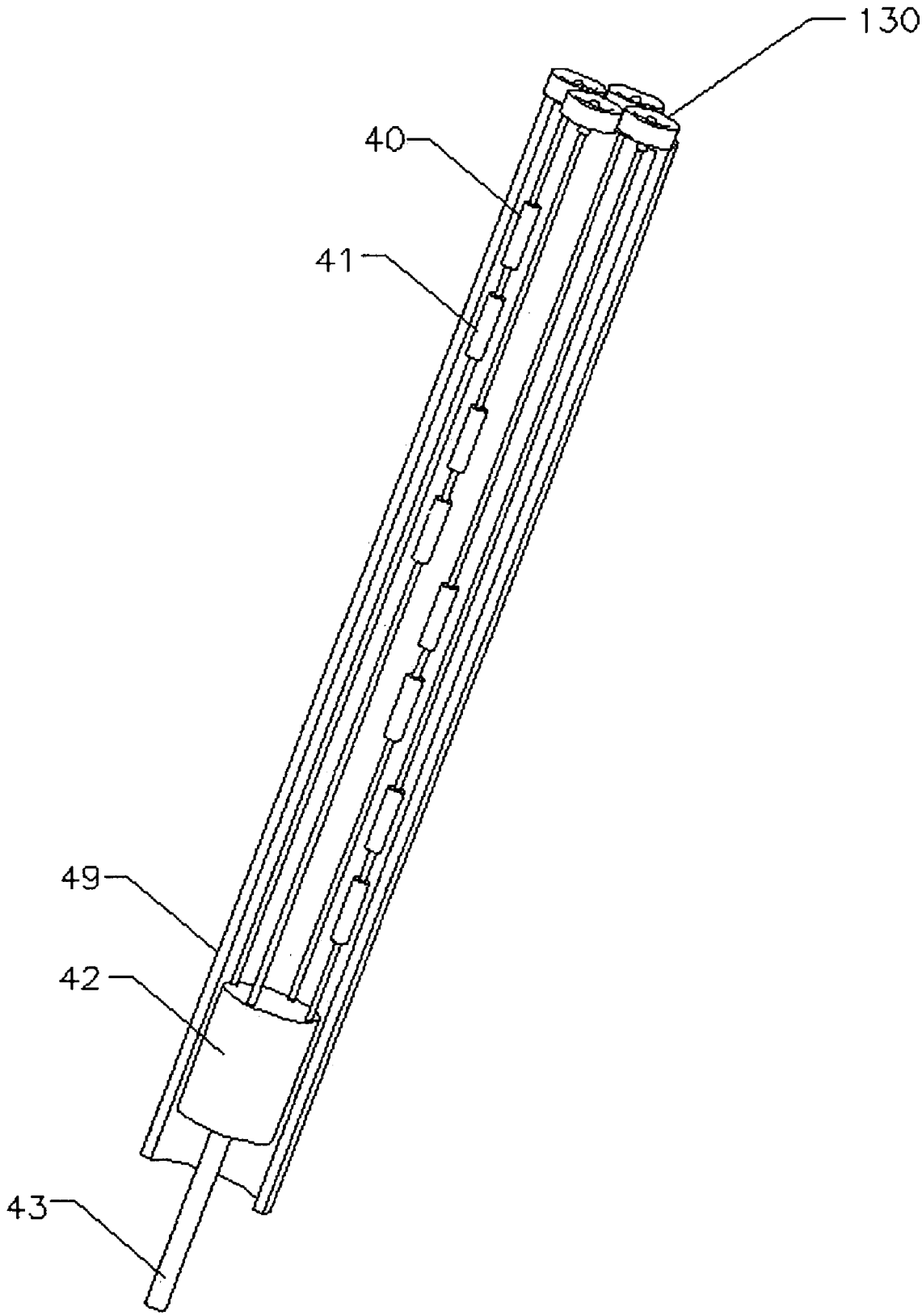
FIG. 10 shows a multi-electrode set drill showing internal circuit components and a flexible cable.
Figure 11:
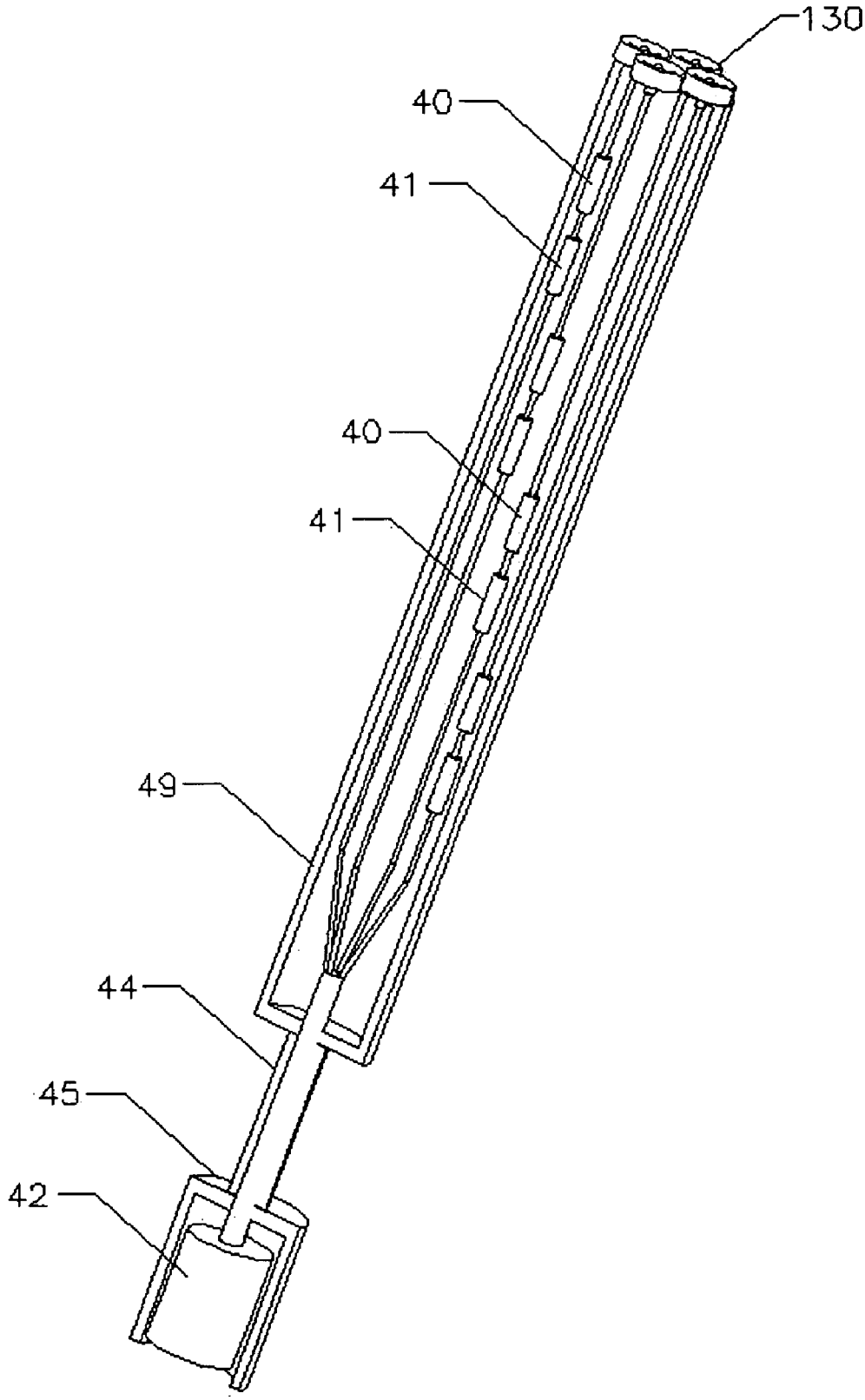
FIG. 11 shows a multi-electrode set drill showing internal circuit components, a flexible cable, and a pulse generator.

FIG. 9 shows an embodiment of multi-electrode set drill tip 130 for directional drilling, showing high-voltage electrodes 132, inter-electrode insulator 133, and ground return electrodes 131 and 135. FIG. 10 shows the multi-electrode set embodiment of the drill showing a plurality of electrode sets 130, mounted on the tip of drill stem 49, capacitors 40, inductors 41, and switch 42 to connect each of the electrode sets to flexible cable 43 from the pulse generator (not shown). FIG. 11 shows multi-conductor cable 44 connecting electrode sets 130 and capacitors 40 and inductors 41 to diverter switch 42 located in pulse generator assembly 45.

The operation of the drill is preferably as follows. The pulse generator is set into a location from which to drill a number of holes. The operator sets up a jack leg and installs the drill in the cradle with the advance mechanism engaging the armored jacket and the boot installed on the tip. The drill is started in its hole at the correct angle by the cradle on the jack leg. The boot has an offset in order to accommodate the angle of the drill to the rock. Once the drill is positioned, the operator goes to the control panel, selects the drill stem to use and pushes the start button which turns on drilling fluid flow. The drill control system first senses to make sure there is adequate drilling fluid pressure in the drill. If the drill is not pressed up against the rock, then there will not be adequate drilling fluid pressure surrounding the drill tips and the drill will not fire. This prevents the operator from engaging the wrong drill and also prevents the drill from firing in the open air when drilling fluid is not surrounding the drill tip. The drill then starts firing at a repetition rate of several hertz to hundreds of hertz. Upon a fire command from the control system, the primary switch connects the capacitors, which have been already charged by the power supply, to the cable. The electrical pulse is then transmitted down the cable to the stem where it pulse charges the stem capacitor. The resulting electric field causes the rock to break down and causes current to flow through the rock from electrode to electrode. This flowing current creates a plasma which fractures the rock. The drilling fluid that is flowing up from the drill stem then sweeps the pieces of crushed rock out of the hole. The drilling fluid flows in a swirl motion out of the insulator and sweeps up any particles of rock that might have drifted down inside the drill stem and flushes them out the top. When the drill is first starting, the rock particles are forced out under the lip of the boot. When the drill is well into the rock then the rock particles are forced out along the side between the drill and the rock hole. The drill maintains its direction because of its length. The drill should maintain adequate directional control for approximately 4-8 times its length depending on the precision of the hole.

While the first drill is drilling, the operator then sets up the other jack-leg and positions the second drill. Once the first drill has completed drilling, the operator then selects the second drill and starts it drilling. While the second drill is drilling, the operator moves the first drill to a new location and sets it up to be ready to drill. After several holes have been drilled, the operator will move the pulse generator box to a new location and resume drilling.

The following further summarizes features of the operation of the system of the present invention. An electrical pulse is transmitted down a conductor to a set of removable electrodes where an arc or plasma is created inside the rock between the electrodes. Drilling fluid flow passes between the electrodes to flush out particles and maintain cleanliness inside the drilling fluid cavity in the region of the drilling tip. By making the drill tips easily replaceable, for example, thread-on units, they can be easily replaced in the mine environment to compensate for wear in the electrode gap. The embedded drilling fluid channels provide drilling fluid flow through the drill stem to the drill tip where the drilling fluid flushes out the rock dust and chips to keep from clogging the interior of the drill stem with chips and keep from shorting the electrical pulse inside the drill stem near the base of the drill tip.

Mine water is drawn into the pulse generator and is used to cool key components through a heat exchanger. Drilling fluid is used to flush the crushed rock out of the hole and maintain drilling fluid around the drill tip or head. The pulse generator box is hermetically sealed with all of the high voltage switches and cable connections inside the box. The box is pressurized with a gas or filled with a fluid or encapsulated to insulate it. Because the pulse generator is completely sealed, there is no potential of exposing the mine atmosphere to a spark from it. The drill will not operate and power will not be sent to the drill stem unless the drilling fluid pressure inside the stem is high enough to ensure that the drill tip is completely flooded with drilling fluid. This will prevent a spark from occurring in air at the drill tip. These two features should prevent any possibility of an open spark in the mine.

There is significant inductance in the circuit between the pulse generator and the drill stem. This is unavoidable because the drill stem must be positioned some distance away from the pulse generator. Normally, such an inductance would create a significant inefficiency in transferring the electrical energy to the plasma. Because of the inductance, it is difficult to match the equivalent source impedance to the plasma impedance. The stem capacitor greatly alleviates this problem and significantly increases system efficiency by reducing inductance of the current flow to the rock.

By utilizing multiple drills from a single pulse generator, the system is able to increase productivity and reduce manpower cost. The adjustable guide loops on the jack leg enable the drill to feed into the roof at an angle to accommodate the rock stress management and layer orientation in a particular mine.

The embodiment of the portable electrocrushing mining drill as shown in FIG. 5, can be utilized to drill holes in the roof of a mine for the insertion of roof bolts to support the roof and prevent injury to the miners. In such an application, one miner can operate the drill, drilling two holes at a rate much faster than a miner could drill one hole with conventional equipment. The miner sets the angle of the jack leg and orients the drill to the roof, feeds the drill stem up through the guide loops and through the boot to the rock with the armored cable engaged in the advance mechanism. The miner then steps back out of the danger zone near the front mining face and starts the drill in operation. The drill advances itself into the roof by the advance mechanisms with the cuttings, or fines, washed out of the hole by the drilling fluid flow. During this drilling process, the miner then sets up the second drill and orients it to the roof, feeds the drill stem through the boot and the guide loops so that when the first drill is completed, he can then switch the pulse generator over to the second drill and start drilling the second hole.

The same drill can obviously be used for drilling horizontally, or downward. In a different industrial application, the miner can use the same or similar dual drill set-up to drill horizontal holes into the mine face for inserting explosives to blow the face for recovering the ore. The embodiment of drilling into the roof is shown for illustration purposes and is not intended as a limitation.

The application of this drill to subsurface drilling is shown for illustration purposes only. The drill can obviously be used on the surface to drill shallow holes in the ground or in boulders.

In another embodiment, the pulse generator can operate a plurality of drill stems simultaneously. The operation of two drill stems is shown for illustration purposes only and is not intended to be a limitation.

Another industrial application is the use of the present invention to drill inspection or anchoring holes in concrete structures for anchoring mechanisms or steel structural materials to a concrete structure. Alternatively, such holes drill in concrete structures can also be used for blasting the structure for removing obsolete concrete structures.

It is understood from the description of the present invention that the application of the portable electrocrushing mining drill of present invention to various applications and settings not described herein are within the scope of the invention. Such applications include those requiring the drilling of small holes in hard materials such as rock or concrete.

Thus, a short drill stem length provides the capability of drilling deep holes in the roof of a confined mine space. A flexible cable enables the propagation of the drill into the roof to a depth greater than the floor to roof height. The electrocrushing process enables high efficiency transfer of energy from electrical storage to plasma inside the rock, thus resulting in high overall system efficiency and high drilling rate.

The invention is further illustrated by the following non-limiting example.

EXAMPLE

The length of the drill stem is fifty cm, with a 5.5 meter long cable connecting it to the pulse modulator to allow operation in a one meter roof height. The drill is designed to go three meters into the roof with a hole diameter of approximately four cm. The drilling rate is approximately 0.5 meters per minute, at approximately seven to ten holes per hour.

The drill system has two drills capable of operation from a single pulse generator. The drill stem is mounted on a holder that locates the drill relative to the roof, maintains the desired drill angle, and provides advance of the drill into the roof so that the operator is not required to hold the drill during the drilling operation. This reduces the operator's exposure to the unstable portion of the mine. While one drill is drilling, the other is being set up, so that one man is able to safely operate both drills. Both drills connect to the pulse generator at a distance of a few meters. The pulse modulator connects to the power supply which is located one hundred meters or more away from the pulse generator. The power supply connects to the mine power.

The pulse generator is approximately sixty cm long by sixty cm in diameter not including roll cage support and protection handles. Mine drilling fluid is used to cool key components through a heat exchanger. Drilling fluid is used to flush out the cuttings and maintain drilling fluid around the drill head. The pulse generator box is hermetically sealed with all of the high voltage switches and cable connections inside the box. The box is pressurized with an inert gas to insulate it. Because the pulse generator is completely sealed, there is no potential of spark from it.

The drill will not operate and power will not be sent to the drill unless the drilling fluid pressure inside the stem is high enough to ensure that the drill tip is completely flooded with drilling fluid. This will prevent a spark from occurring erroneously at the drill tip. The boot is a stiff rubber piece that fits snugly on the top of the drill support and is used to contain the drilling fluid for initially starting the drilling process. Once the drill starts to penetrate into the rock, the boot slips over the boot holder bulge and slides on down the shaft. The armored cable is of the same diameter or slightly smaller than the drill stem, and hence the boot will slide down the armored cable as the drill moves up into the drill hole.

The preceding examples can be repeated with similar success by substituting the generically or specifically described components, mechanisms, materials, and/or operating conditions of this invention for those used in the preceding examples.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above are hereby incorporated by reference.

What is claimed is:

1. A pulsed power apparatus for passing a pulsed electrical current through a substrate to drill the substrate, said apparatus comprising:

a drill;

a pulse generator;

an electrode assembly comprising said at least one set of at least two electrodes disposed on said drill passing pulsed electrical current from said pulse generator through the substrate; and said at least one electrode set changeably directing drilling of said drill through the substrate.

2. The apparatus of claim 1 further comprising a cable connecting said electrode assembly to said pulse generator.

3. The apparatus of claim 2 wherein said drill further comprises a switch alternately connecting said at least one electrode set to said pulse generator via said cable.

4. The apparatus of claim 2 wherein said cable comprises at least one conductor connecting each of a plurality of said electrode sets independently to said pulse generator.

5. The apparatus of claim 2 wherein said pulse generator comprises a switch alternately connecting said pulse generator to at least one conductor of said cable connecting each of a plurality of said electrode sets independently to said pulse generator.

6. The apparatus of claim 1 wherein said drill further comprises a plurality of capacitors located in said drill providing part or all of an electrical current feed to plasmas of each of a plurality of said electrode sets.

7. The apparatus of claim 1 wherein said drill further comprises a circuit component selected from the group consisting of capacitors, switches, inductors, and a combination thereof, disposed on said drill providing part or all of an electrical current feed to plasmas of each of a plurality of said electrode sets.

8. The apparatus of claim 2 wherein said pulse generator comprises a switch alternately connecting said pulse generator to at least one conductor of said cable connecting each of a plurality of said electrode sets independently to said pulse generator, each of a plurality of said electrode sets further comprising a circuit component selected from the group consisting of capacitors, inductors, other circuit components, or combinations thereof disposed in said drill providing part or all of an electrical current feed to plasmas of each said electrode set.

9. The apparatus of claim 1 further comprising a fluid flow component providing flushing fluid to said drill.

10. The apparatus of claim 9 wherein said fluid comprises an electrical conductivity less than approximately $10^{-5}$ mho/cm.

11. The apparatus of claim 9 wherein said fluid comprises treated water.

12. The apparatus of claim 9 wherein the fluid comprises a dielectric constant greater than approximately 6.

13. The apparatus of claim 9 wherein the fluid comprises a conductivity less than approximately $10^{-4}$ mho/cm.

14. The apparatus of claim 13 wherein the fluid comprises a dielectric constant greater than approximately 40.

15. The apparatus of claim 1 wherein said at least two electrodes define therebetween at least one electrode gap.

16. The apparatus of claim 1 wherein said electrodes are oriented substantially along a face of said drill.

17. The apparatus of claim 1 wherein said drill comprises a drill stem assembly enclosing and supporting said electrode assembly.

18. The apparatus of claim 1 wherein said drill comprises a drill stem and a drill tip.

19. The apparatus of claim 1 wherein said pulse generator comprises a variable rate high-voltage pulse generator, said variable rate comprising a higher-repetition rate and a lower-repetition rate.

20. The apparatus of claim 1 wherein said pulse generator provides variable rate pulses.

21. The apparatus of claim 20 wherein said pulses comprise a higher-repetition rate pulse and a lower-repetition rate pulse.

22. The apparatus of claim 21 wherein said electrode set is fed with said higher-repetition rate pulse for changeably directing drilling.

23. A method for passing a pulsed electrical current through a substrate, said method comprising:

providing a drill, an electrode assembly comprising at least one set of at least two electrodes, and a cable connected to a pulse generator;

disposing at least one set of at least two electrodes on the drill;

passing current from the pulse generator through the electrodes and through the substrate; and changeably directing drilling of the drill through the substrate using the at least one set of electrodes.

24. The method of claim 23 further comprising alternately connecting the electrode sets to the pulse generator by a switch in the drill via the cable.

25. The method of claim 23 further comprising connecting the cable comprising at least one conductor independently to each of a plurality of the electrode sets and to the pulse generator.

26. The method of claim 23 further comprising alternately connecting the pulse generator to multiple conductors of the cable by a switch in the pulse generator and connecting each of the electrode sets independently to the pulse generator.

27. The method of claim 23 further comprising disposing a plurality of capacitors on the drill, disposing the capacitors in the drill, and providing part or all of the electrical current feed via the capacitors to plasmas of each electrode set.

28. The method of claim 23 further comprising incorporating a circuit component selected from the group consisting of capacitors, switches, inductors, and a combination thereof to the drill, disposing the circuit component in the drill, and providing part or all of the electrical current feed via the circuit components to plasmas of each electrode set.

29. The method of claim 23 further comprising alternately connecting the pulse generator via a switch to multiple conductors of the cable, connecting each of a plurality of the electrode sets independently to the pulse generator, and providing part or all of the electrical current feed to plasmas of each electrode set via each electrode set, the electrode sets further comprising a circuit component selected from the group consisting of capacitors, inductors and other circuit components located in the drill.

30. The method of claim 23 further comprising providing fluid to the drill.

31. The method of claim 30 wherein the fluid comprises an electrical conductivity less than approximately $10^{-5}$ mho/cm.

32. The method of claim 30 wherein the fluid comprises treated water.

33. The method of claim 30 wherein the fluid comprises a conductivity less than approximately $10^{-4}$ mho/cm.

34. The method of claim 30 wherein the fluid comprises a dielectric constant greater than approximately 40.

35. The method of claim 23 further comprising generating a variable rate high-voltage pulse from the pulse generator, having a higher-repetition rate and a lower-repetition rate.

36. The method of claim 35 comprising changeably directing drilling of the drill through the substrate towards the at least one electrode set fed with the higher-repetition-rate pulse from the pulse generator.

37. The method of claim 23 further comprising independently supplying an electric current to the at least one electrode set using the cable.

38. The method of claim 23 further comprising defining at least one electrode gap between at least two electrodes.

39. The method of claim 23 further comprising orienting the electrodes of each set of electrodes substantially along a face of the drill.

40. The method of claim 30 wherein the fluid comprises a dielectric constant greater than approximately 6.

* * * * *